United States Patent [19]

Hoffman

[11] Patent Number: 4,999,967

[45] Date of Patent: Mar. 19, 1991

[54] APPARATUS FOR DRAPING PACKETS INTO BLANKS OF WRAPPING MATERIAL

[75] Inventor: Gottfried Hoffman, Schwarzenbek, Fed. Rep. of Germany

[73] Assignee: Körber AG, Hamburg, Fed. Rep. of Germany

[21] Appl. No.: 291,552

[22] Filed: Dec. 29, 1988

[30] Foreign Application Priority Data

Jan. 9, 1988 [DE] Fed. Rep. of Germany ..... 3800432

[51] Int. Cl.[5] ..... B65B 11/28; B65B 57/12

[52] U.S. Cl. ..... 53/64; 53/234; 53/389.1

[58] Field of Search ..... 53/64, 232, 234, 389, 53/228

[56] References Cited

U.S. PATENT DOCUMENTS

| | | | |
|---|---|---|---|
| 2,180,163 | 11/1939 | Milmoe | 53/234 |
| 3,274,870 | 9/1966 | Schmermund | 53/389 X |
| 3,385,026 | 5/1968 | Schmermund | 53/389 X |
| 3,898,900 | 8/1975 | Schmermund | 83/349 X |
| 4,083,165 | 4/1978 | Maldina | 53/234 X |
| 4,135,349 | 1/1979 | Seragnoli | 53/64 X |

FOREIGN PATENT DOCUMENTS

| | | | |
|---|---|---|---|
| 3515655 | 11/1985 | Fed. Rep. of Germany | 53/234 |

*Primary Examiner*—John Sipos

*Attorney, Agent, or Firm*—Peter K. Kontler

[57] ABSTRACT

Apparatus for draping successive cigarette packs into blanks of light-transmitting material has a turret with radially extending open-ended pockets and is indexible to move successive pockets to a predetermined position of register with a fixed mouthpiece. A web of wrapping material is transported downwardly by a conveyor having independently driven upper and lower units. A severing device cuts across the leader of the web between the two conveying units to form a series of discrete blanks which are pushed by the respective packs through the mouthpiece and into the registering pockets of the turret. The lower conveying unit delivers successive blanks in front of the mouthpiece and can be accelerated to move blanks out of the way in the absence of packs as well as to evacuate blanks prior to stoppage of the apparatus.

23 Claims, 2 Drawing Sheets

APPARATUS FOR DRAPING PACKETS INTO BLANKS OF WRAPPING MATERIAL

BACKGROUND OF THE INVENTION

The invention relates to improvements in apparatus for draping objects into blanks of wrapping material, especially for draping packets (such as cigarette packs which issue from a cigarette packing machine) into discrete blanks, e.g., into blanks which consist of a light-transmitting material and are to be converted into the outermost envelopes of packets.

It is customary to provide each cigarette pack with at least one inner envelope of cardboard, paper or plastic material, and to thereupon provide each pack with an outer envelope which normally transmits light and is often provided with a so-called tear strip to facilitate separation of the outer envelope from the remainder of the pack. For example, if cigarette packs are of the type known as flip top packs, the top can be pivoted to open position as soon as the outer envelope is removed.

OBJECTS OF THE INVENTION

An object of the invention is to provide a novel and improved apparatus which can drape discrete objects (such as freshly formed cigarette packs) into discrete blanks of deformable wrapping material at a frequency exceeding that which can be achieved and maintained in conventional apparatus.

Another object of the invention is to provide a novel and improved cellophaner for cigarette packs.

A further object of the invention is to provide an apparatus which can process objects, such as block-shaped commodities including cigarette packs, at the same frequency at which such objects issue from a modern fully automated packing or other mass-producing machine.

An additional object of the invention is to provide the apparatus with novel and improved means for accepting draped objects from the blank applying station.

Still another object of the invention is to provide the apparatus with a novel and improved conveyor for the advancement of a web of wrapping material and discrete blanks.

A further object of the invention is to provide the apparatus with novel and improved means for synchronizing the operation of two or more of its assemblies so as to ensure predictable and reproducible draping of successive objects.

Another object of the invention is to provide the above outlined apparatus with means for automatically discarding or ejecting blanks which are not likely to encounter objects at the blank applying station.

An additional object of the invention is to provide novel and improved drives for various conveyors and other moving parts of the above outlined apparatus.

A further object of the invention is to provide the apparatus with novel and improved means for preventing stray movements of blanks relative to the respective objects and/or vice versa.

Another object of the invention is to provide the apparatus with novel and improved means for carrying out operations which facilitate grasping of the free ends of tear strips which form part of outer envelopes of cigarette packs or other block-shaped commodities.

A further object of the invention is to provide a novel and improved method of applying discrete blanks of flexible sheet material to a succession of block-shaped commodities which are supplied at a high frequency.

An additional object of the invention is to provide an apparatus which can be incorporated into or combined, e.g., in a production line, with a high-speed cigarette packing machine.

SUMMARY OF THE INVENTION

The invention is embodied in an apparatus for draping objects into blanks of wrapping material, particularly for draping packets of cigarettes or other smokers' products into light-transmitting foils. The improved apparatus comprises a first conveyor having a plurality of open pockets movable along an endless first path wherein successive pockets are caused to assume a predetermined position, a second conveyor having means for advancing a web of deformable wrapping material along a predetermined second path in front of the pocket which occupies the predetermined position, means for subdividing the leader of the web into a series of successive blanks in a predtermined portion of the second path which is adjacent the pocket occupying the predetermined position, a third conveyor having means for transporting successive objects of a series of objects in front of the blanks in the predetermined portion of the second path, and means for individually inserting objects into pockets occupying the predetermined position including means for moving the objects against the blanks occupying the predetermined portion of the second path so that the blanks are draped around the objects entering the respective pockets.

The first conveyor can constitute or include a rotary turret which is indexible about a predetermined axis, preferably about a substantially horizontal axis.

The apparatus can further comprise a guide for objects which are being moved into the registering pockets. Such guide can include a mouthpiece which is disposed between the second portion of the second path and the pocket which occupies the predetermined position so that the blanks which are being draped around objects are compelled to pass through the mouthpiece.

The apparatus further comprises a source of wrapping material, and the advancing means of the second conveyor comprises means for drawing the web from the source.

The advancing means of the second conveyor preferably comprises a first endless conveyor unit which defines a first portion of the second path, and a second endless conveying unit which defines a second portion of the second path downstream of the first portion. The second conveyor preferably further comprises discrete drive means for the first and second conveying units. One of the drive means can receive motion from a main prime mover, e.g., from the prime mover of a packing machine which discharges the aforementioned series of successive objects. The one drive means preferably drives the first conveying unit, and the apparatus preferably further comprises means for disconnecting (when necessary) the one drive means from the main prime mover.

The drive means for the second conveying unit is preferably provided with separate control means.

The second conveyor further comprises means for drawing the web from a suitable source (such as a bobbin or reel). The drawing means can comprise a pair of rolls which define a nip for the web, and the drive means for the first conveying unit of the second conveyor is preferably arranged to drive at least one roll of the drawing means.

The subdividing means is disposed between the first and second conveying units, and each of these conveying units preferably comprises at least one endless foraminous belt conveyor and means (such as suction chambers) for establishing a pressure differential between opposite sides of the belt conveyors so as to pneumatically hold (e.g., attract by suction) the web and the blanks in the second path. In accordance with a presently preferred embodiment, each conveying unit comprise a plurality of endless foraminous belts, particularly two belts (i.e., one for each marginal portion of the web or a blank).

The apparatus preferably comprises means for making cuts in the blanks at those locations where the free ends of customary tear strips are to be formed. Such apparatus preferably comprises common drive means for the severing means and for the means which makes cuts in the blanks. The cuts can be made prior or subsequent to separation of blanks from the web. The severing means can comprise a rotary cross cutter at one side and a fixed counterknife at the other side of the second path. The aforementioned common drive means for the severing means and for the means which makes cuts in the blanks can comprise variable-speed drive means for the cross cutter of the severing means.

The third conveyor can comprise an endless conveyor (e.g., an endless belt conveyor) which serves to advance the objects along a third path, and means (such as an elevator) for transferring objects from the endless conveyor to positions in front of the moving means, i.e., between the moving means and the aforementioned mouthpiece. The moving means can comprise a reciprocable pusher which is driven by a fluid-operated cylinder and piston unit or by other suitable drive means.

The first conveying unit of the second conveyor is preferably designed to advance the leader of the web to the severing means, and the second conveying unit then serves to advance blanks from the severing means. Such second conveyor preferably further comprises variable-speed drive means for the second conveying unit and control means for accelerating the second conveying unit (when necessary) so as to advance blanks past and beyond the moving means in the absence of an object between the moving means and the pocket which occupies the predetermined position, i.e., which is supposed to receive a blank and an object during the respective cycle of the apparatus. The apparatus preferably further comprises means for monitoring the third conveyor for the absence of objects and for initiating acceleration of blanks by way of the control means and the second conveying unit in response to detected absence of objects on the third conveyor. The monitoring means can comprise a sensor which serves to generate appropriate signals in response to detected absence of objects on the third conveyor. The control means includes means for applying to the drive means for the second conveying unit voltage signals in response to signals from the sensor. Such control means preferably further comprises means for delaying the voltage signals so that the second conveying unit advances a blank beyond the moving means immediately before the moving means performs an idle stroke as a result of the absence of an object between the moving means and the pocket which occupies the predetermined position.

The apparatus preferably further comprises means for synchronizing the operation of the severing means and moving means so that the severing means separates a blank from the leader of the web when the blank which is about to be separated from the leader extends in part (preferably only slightly) into the aforementioned guide under the action of the object which is being moved by the moving means. Still further, the apparatus preferably comprises means for synchronizing the operation of the second conveyor with the operation of the moving means so that the speed of the second conveyor matches the speed of the moving means during separation of blanks from the leader of the web.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWINGS

FIG. 1 is a somewhat schematic elevational view of an apparatus which embodies one form of the invention and is designed to drape block-shaped commodities into blanks of flexible wrapping material, such as a web of thin plastic foil or the like.

DESCRIPTION OF PREFERRED EMBODIMENTS

Figure 1:
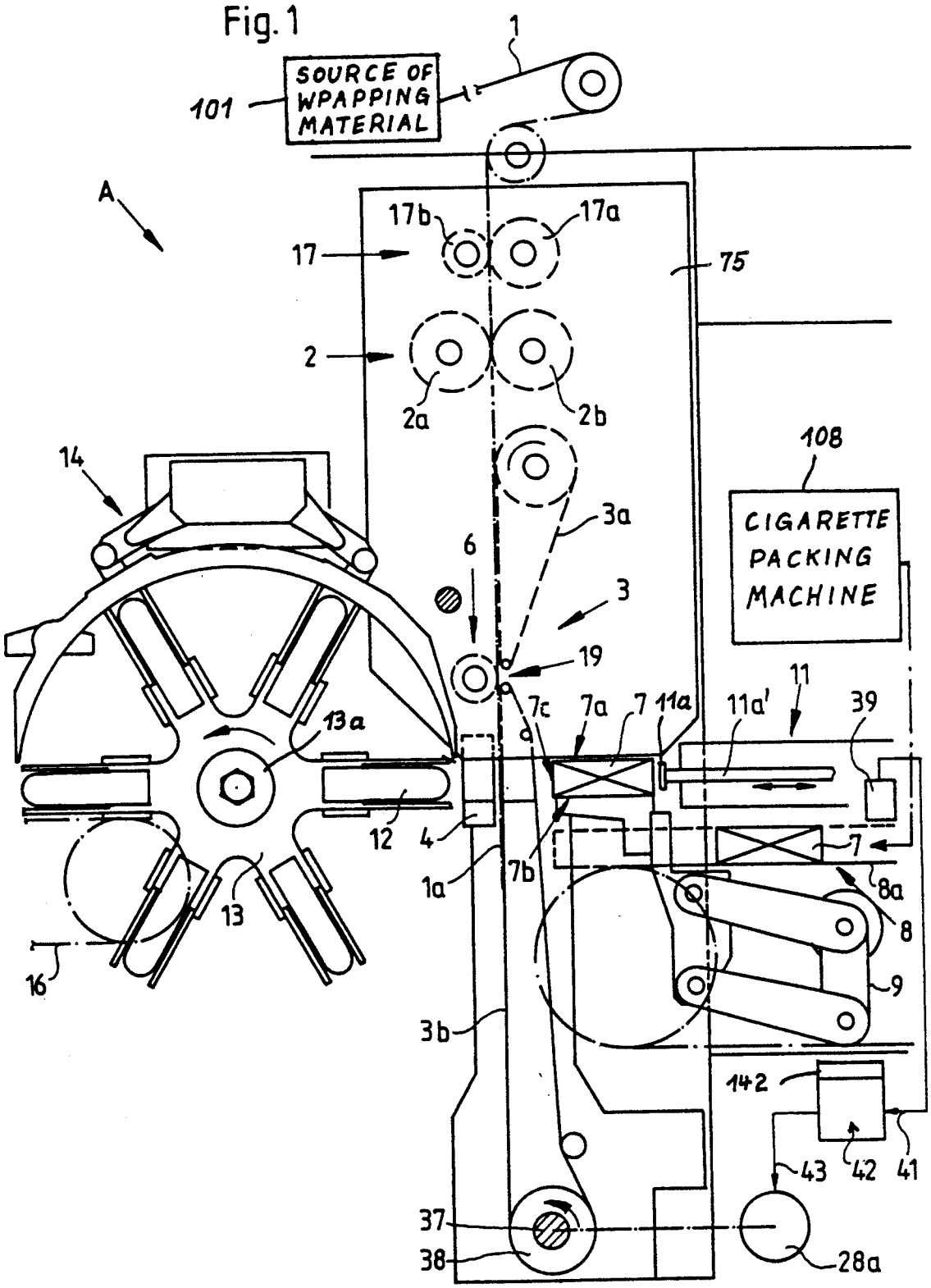

FIG. 1 shows a source 101 of deformable wrapping material, e.g., a continuous web 1 which can constitute a light-transmitting foil of plastic material. The apparatus which serves to drape successive block-shaped commodities 7, hereinafter called packets or cigarette packs, into discrete blanks 1*a* of wrapping material comprises a first conveyor 13 having an annulus of open-ended radial pockets 12 for reception of partially draped packets 7, a second conveyor 3 which serves to advance the web 1 along a predetermined (e.g., substantially vertical) path past a severing station 19 accommodating a severing device 6 which repeatedly severs the leader of the web 1 to form a series of successive blanks 1*a*, a third conveyor 8 which serves to advance successive packets 7 of a short or long series of packets to a draping station at a level beneath the severing station 19, and an inserting device 11 having a reciprocable pusher 11*a* constituting a means for moving successive packets 7 against the blanks 1*a* at the draping station and for moving such packets and the respective blanks into the adjacent registering pockets 12 of the first conveyor 13.

The conveyor 3 comprises a web drawing device 2 including two rolls 2*a*, 2*b* which are disposed at opposite sides of the path for the web 1 and define a nip for successive increments of the running web. The conveyor 3 further comprises a first or upper conveying unit 3*a* which accepts the web 1 from the rolls 2*a*, 2*b* and advances the leader of the web into the range of the severing device 6, and a second or lower conveying unit 3*b* which advances successive blanks 1*a* to positions for engagement by the oncoming packets 7 and for insertion into the registering pockets 12 of the conveyor 13. Successive blanks 1*a* are placed behind a stationary guide 4 in the form of a hollow mouthpiece which registers with the foremost empty pocket 12 of the conveyor 13 and ensure that the blanks 1*a* are converted into U-shaped bodies on their way through the mouthpiece and into the respective pockets 12.

The severing device 6 comprises a rotary cross cutter 6*a* at one side and a stationary (fixed) counterknife 6*b* at the other or opposite side of the path for the web 1.

The conveyor 8 comprises an endless belt conveyor 8*a* which can but need not be provided with partitions to define discrete compartments for individual packets 7, e.g., for cigarette packs issuing from a high-speed cigarette packing machine 108, such as a machine of the type produced and sold by the assignee of the present application and known as COMPAS 500. The conveyor 8*a* advances the packets 7 cyclically (stepwise) at the rate they issue from the packing machine 108 and delivers the packets into the range of a transferring device in the form of an elevator 9 which forms-part of the third conveyor 8 and serves to raise successive packets 7 from the level of the upper reach of the endless conveyor 8*a* to a level in front of the pusher 11*a* of the inserting device 11. The pusher 11*a* is reciprocable forwardly and backwards (i.e., toward and away from the mouthpiece 4) at a frequency which is determined by the speed of the packing machine 108. The drive means for reciprocating the pusher 11*a* comprises a fluid-operated (hydraulic or pneumatic) motor having a cylinder and piston unit with a piston rod 11*a*′ which is attached to the pusher 11.

The illustrated conveyor 13 constitutes or includes a turret which is indexible about a horizontal axis by the output shaft 13*a* of a Geneva movement or in any other suitable way to ensure that successive pockets 12 assume a predetermined position of register with the mouthpiece 4 during successive intervals of idleness or dwell of the turret 13.

When the apparatus is in actual use, the conveying unit 3*b* advances successively formed blanks 1*a* into a predetermined portion of the vertical path, namely into the path portion between the reciprocable pusher 11*a* and the mouthpiece 4. As the pusher 11*a* advances toward the shaft 13*a*, it separates the blank 1 from the conveying unit 3*b* by way of the foremost packet 7 (on the elevator 9 of the conveyor 8) and the blank is automatically draped over the narrow front side 7*c* as well as over the top side 7*a* and bottom side 7*b* of the advancing packet 7 before it enters the aligned empty pocket 12 of the turret 13. Thus, successive blanks 1*a* are converted into U-shaped bodies which are thereupon subjected to the action of one or more conventional draping, tucking, folding and other instrumentalities (one of which is indicated at 14) so as to convert the U-shaped body into an envelope which closely surrounds all six sides of the respective packet 7. The thus finished packets 7 are accepted by a take-off conveyor 16 (e.g., an endless belt conveyor) which transports such packets to the next processing station, e.g., to a carton filling station of any known design. Suitable carton filling apparatus (also called boxers) are produced and sold by the assignee of the present application and are known as B90.

Outer envelopes of cigarette packs are normally provided with so-called tear strips which facilitate opening of such envelopes and their separation from the inner envelope or envelopes of the packs. The free front end of a tear strip is accessible due to the provision of a U-shaped or similar cut in a panel of the outer envelope. In order to make such cuts in successive blanks 1*a* (preferably prior to actual separation of blanks from the remainder of the web 1), the improved apparatus comprises a cut making device 17 which can be readily seen in the upper portion of FIG. 2 and comprises a rotary drum-shaped knife 17*a* with a substantially U-shaped cutting edge 18 at one side, and a cylindrical counterknife 17*b* at the other side, of the path of downward movement of the web 1 toward the nip of the rolls 2*a*, 2*b*. The cutting edge 18 provides spaced-apart portions of the web 1 with substantially U-shaped cuts which surround the free ends of the respective tear strips. The peripheral speed of the rolls 2*a*, 2*b* is related to the peripheral speed of the knife 17*a* in such a way that the U-shaped cuts are located in predetermined portions of successive discrete blanks 1*a* so that the purchaser of a finished cigarette pack knows where to look for the free end of the tear strip.

The upper conveying unit 3*a* of the conveyor 3 comprises two spaced-apart endless foraminous belts 3*a*1, 3*a*2 which serve to attract the respective marginal portions of the web 1 and to thus maintain the leader of the web in a predetermined path. The vertically extending downwardly moving reaches of the belts 3*a*1, 3*a*2 are respectively located in front of suction chambers 22*a*, 22*b* which have outlets 24*a*, 24*b* for connection to a suitable suction generating device (e.g., a blower), not shown. The chambers 22*a*, 22*b* establish a pressure differential between opposite sides of the respective vertical reaches to thus ensure that the marginal portions of the web 1 are pneumatically held by the outer sides of the vertical reaches during advancement toward the severing device 6 which is installed in the frame 75 of the apparatus at the severing station 19, namely in the space between the conveying units 3*a* and 3*b*. The severing station 19 (i.e., the gap between the conveying units 3*a* and 3*b*) is very narrow to ensure that the foremost part of the leader of the web 1 can readily advance across such gap and into the range of the uppermost portions of vertical reaches of endless foraminous belts 3*b*1, 3*b*2 forming part of the conveying unit 3*b*, i.e., it is not necessary to employ specially designed transporting and/or guide means in order to ensure that the foremost portion of the web 1 will reliably advance toward engagement by the conveying unit 3*b* upon completion of each severing operation. The vertical reaches of the endless foraminous belts 3*b*1, 3*b*2 are disposed in front of suction chambers 23*a*, 23*b* which have outlets 26*a*, 26*b* for connection to the aforementioned suction generating device or to a discrete second suction generating device. The illustrated belts 3*a*1, 3*a*2, 3*b*1, 3*b*2 are perforated; their holes are shown at 21. An advantage of the illustrated conveying units 3*a* and 3*b* is that they can reliably transport the web 1 and the blanks 1*a* without slippage but permit separation of the web from the vertical reaches of the belts 3*a*1, 3*a*2 and separation of blanks from the vertical reaches of the belts 3*b*1, 3*b*2 for the purpose of advancing the web across the severing station 19 and of introducing the blanks 1*a* into the mouthpiece 4.

The second conveyor 3 further comprises discrete drives 27 and 28 for the belts of the conveying units 3*a* and 3*b*. The drive 27 for the conveying unit 3*a* comprises a motor 27*a* which is normally coupled to the main prime mover 127 of the packing machine 108 by way of a suitable operative connection 227 which can be interrupted by a disconnecting means 327 (e.g., a clutch) so that the prime mover 127 can operate while the motor 27*a* is idle or vice versa.

The drive 27 preferably further serves to transmit motion to the web drawing device 2, namely to the roll 2b. To this end, the shaft 32 of the roll 2b is directly driven by the motor 27a and carries a toothed pulley 31 for an endless toothed belt 29 which is further trained over a toothed pulley 33 on the shaft 34 of the pulleys 36 for the upper end portions of endless foraminous belts 3a1, 3a2 of the upper conveying unit 3a. The lower pulleys for the belts 3a, 3a2 are small-diameter idler pulleys which are immediately adjacent the stationary counterknife 6b of the severing device 6. The motor 27a can drive the roll 2b and the conveying unit 3a independently of the main prime mover 127 in response to interruption of the operative connection 227 by the disconnecting means 327. This renders it possible to operate the improved apparatus independently of the packing machine 108, i.e., the conveyor 8 can receive packets 7 from a source other than the machine 108.

The drive 28 for the second conveying unit 3b comprises a motor 28a which can be controlled independently of the motor 27a. The motor 28a can drive a shaft 37 for pulleys 38. The belts 3b1 and 3b2 of the conveying unit 3b are trained over the pulleys 38 as well as over small idler pulleys which are immediately or closely adjacent the stationary counterknife 6b of the severing device 6. The character 42 denotes a regulating or control unit which can vary the speed of the motor 28a independently of the motor 27a. For example, the speed of the motor 28a will deviate from the speed of the motor 27a (i.e., the speed of the blanks 1a will deviate from the speed of the web 1) if one or more packets 7 are missing, i.e., if an excessive clearance develops between two successive packets 7 on the upper reach of the endless conveyor 8a. In the absence of any undertaking to the contrary, the pusher 11a would perform an idle stroke toward the turret 13 and would push the blank 1a occupying the path portion in front of the mouthpiece 4 into the mouthpiece and thence into the registering pocket 12. In order to avoid such deformation of a blank 1a directly by the pusher 11a rather than by a packet 7, the path of packets 7 on the conveyor 8a is monitored by a sensor 39 (e.g., a photoelectronic sensor) having an output 41 for transmission of signals to the control unit 42 in response to detection of excessive clearances between successive packets 7 on the upper reach of the conveyor 8a. The output 43 of the control unit 42 then transmits a voltage signal which is used to accelerate the motor 28a so that the blank 1a which happens to be in front of the mouthpiece 4 is abruptly accelerated and advances downwardly beyond the mouthpiece before the pusher 11a can engage and deform such blank by pushing it into the moutnpiece and thence into the registering empty pocket 12 of the turret 13. The arrangement is preferably such that the signal at the output 43 of the control unit 42 triggers abrupt acceleration of the conveying unit 3b and of the freshly formed blank 1a with a view to ensure that the trailing end of the blank 1a is advanced downwardly beyond the level of the mouthpiece 4 immediately or shortly before the blank could be reached and deformed by the advancing pusher 11a. The RPM of the motor 28a can be reduced immediately after the blank 1a which would have been deformed directly by the pusher 11a has advanced downwardly beyond the mouthpiece 4.

The control unit 42 preferably comprises a suitable time delay circuit (e.g., a shift register 142) serving to ensure that signals which are transmitted by the output 41 of the sensor 39 are properly delayed so that the output 43 of the control unit 42 transmits a voltage signal (in order to accelerate the motor 28a) at a time when the path in front of the mouthpiece 4 contains that blank 1a which would have been deformed by the pusher 11a rather than by a packet 7.

The sensor 39 can be placed nearer to or at a greater distance from the mouthpiece 4. For example, the sensor 39 can be installed adjacent a conveyor (not shown) which precedes the conveyor 8a and serves to transport packets 7 between the machine 108 and the receiving end of the conveyor 8a. Such non-illustrated conveyor can be provided with compartments or pockets for discrete packets 7. If the sensor 39 (or a second sensor) is placed adjacent such non-illustrated conveyor, it serves to generate signals in response to detection of empty compartments or pockets.

Figure 2:
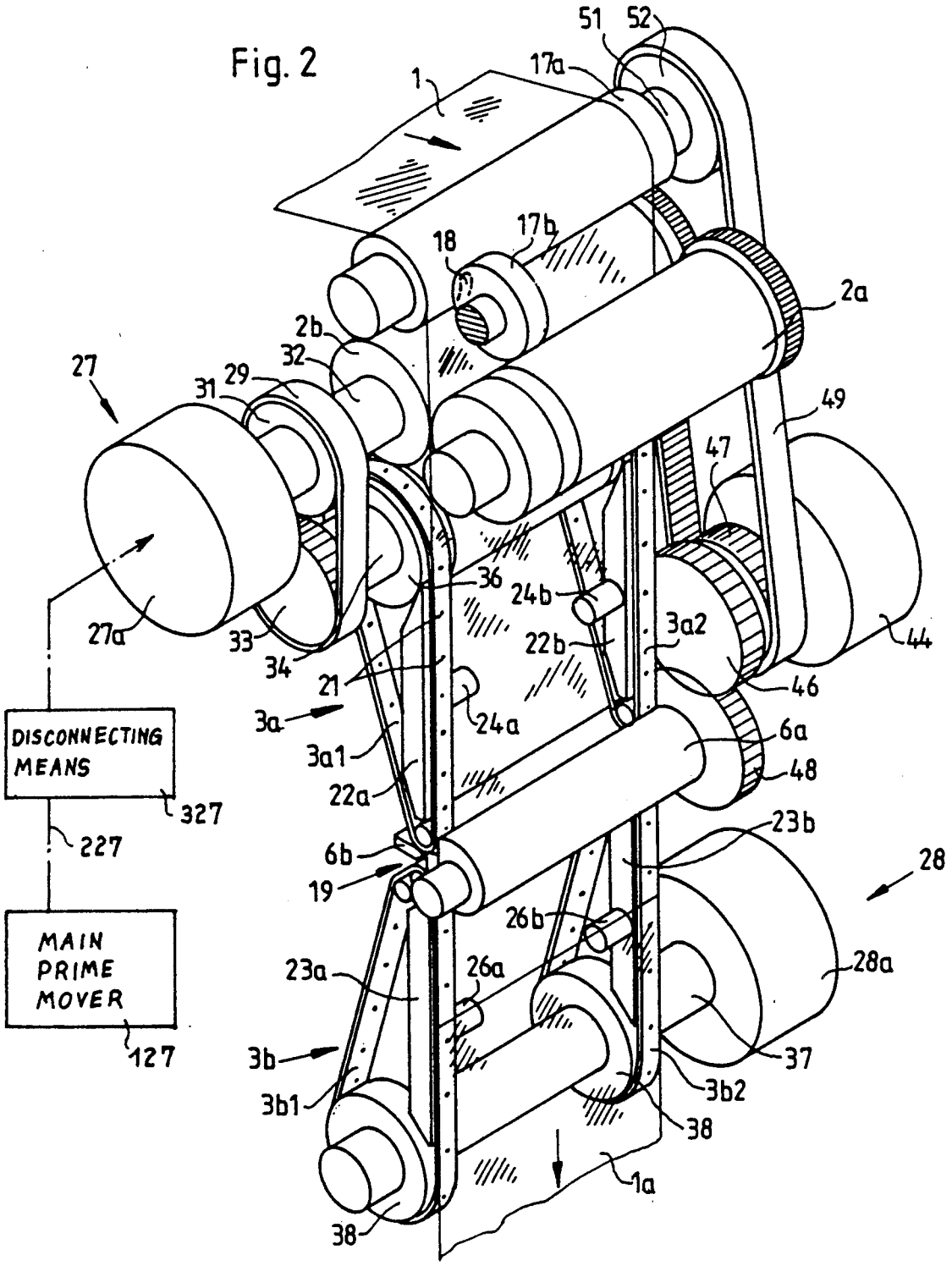
FIG. 2 is an enlarged fragmentary perspective view of the apparatus, substantially as seen in the direction of arrow A in FIG. 1, with the first and third conveyors omitted.

FIG. 2 further shows a drive 44 which is common to the rotary drum-shaped knife 17a of the device 17 and the rotary cross cutter 6a of the severing device 6. The output shaft of the motor 44 carries two gears 46 and 47 which are coaxial with each other and are non-rotatably affixed to the shaft. The gear 46 mates with a gear 48 on the shaft of the cross cutter 6a. The gear 47 serves as a pulley for an endless toothed belt 49 which is further trained over a toothed pulley 52 on a drive shaft 51 for the knife 17a.

The operative connection between the gear 48 and the cross cutter 6a preferably contains a varying velocity ratio transmission (not shown) which constitutes a means for synchronizing the speed of the cross cutter 6a with the speed of the web 1, at least while the device 6 severs the web. Varying velocity ratio transmissions of the type suitable for use in conjunction with the cross cutter 6a are disclosed, for example, in commonly owned U.S. Pat. Nos. 4,201,102 and 4,255,998 to Rudszinat, in U.S. Pat. No. 4,440,051 to Aykut, in U.S. Pat. No. 4,523,502 to Besemann and in U.S. Pat. No. 4,548,404 to Brandt. The disclosures of these patents are incorporated herein by reference.

The peripheral speed of the cross cutter 6a can exceed or can be less than the speed of the web 1 during intervals between successive severing operations. This renders it possible to properly adjust the severing unit 6 for the making of shorter or longer blanks 1a, depending on the dimensions of the packs 7 and on the desired size of tucks, folds and flaps on finished envelopes (converted blanks 1a). An advantage of the just discussed feature is that the cross cutter 6a need not be exchanged if the apparatus is to be set up for the making of longer or shorter blanks 1a.

In accordance with a further feature of the invention, the operation of the drive (including the piston rod 11a') for the pusher 11a is synchronized with the operation of the severing device 6 in such a way that the cross cutter 6a severs the web 1 (in order to separate a blank 1a therefrom) at the instant when the leader of the web (namely the part which is to form the freshly separated blank 1a) is already engaged by the front side 7c of a packet 7 and is introduced, in part (preferably only slightly), into the mouthpiece 4. This ensures that the freshly separated blank 1a is positively guided at all times and is thus less likely or unlikely to perform stray movements relative to the respective packet 7. Furthermore, the speed of the web 1 preferably matches the speed of the pusher 11a and of the packet 7 in front of the pusher when the latter performs a forward stroke and reaches a position in which the front side 7c of the packet 7 has entered the front end of the mouthpiece 4. This ensures that the web 1 is not tensioned as well as that the web 1 is not overly loose (to form folds, pleats or creases) at the time the lowermost portion or leader of the web 1 is being pushed into the mouthpiece 4. Since the speed of the motor including the piston rod 11a' is adjustable, the establishment of the just outlined synchronization between the speeds of the web 1 and pusher 11a will present no purblems to those having the required skill in the art. All that is necessary is to properly select the speed of the web 1 at the time the lowermost portion of the web is already engaged by a packet 7 and the web is about to be severed.

An additional important advantage of the feature that the motor 28a for the second or lower conveying unit 3b can be operated independently of the motor 27a for the first or upper conveying unit 3a is that the operator can decide to evacuate all blanks 1a from the apparatus before the apparatus is brought to a standstill. Thus, it is merely necessary to disengage (at 327) the motor 27a from the prime mover 127 and to continue to operate the motor 28a until all of the blanks 1a are evacuated from the apparatus.

The timing of severing of the web 1 can be altered, for example, to take place when a blank 1a is in the process of entering an empty pocket 12 of the turret 13. All that counts is to ensure that the blanks are positively guided during each and every stage of their formation (i.e., separation from the web 1) and their conversion into envelopes for the respective packets 7. Such positive guidance results in the making of predictable envelopes.

A further important advantage of the improved apparatus is that it can operate properly without the need for complex and expensive transmissions. This is accomplished by the provision of discrete drives for the conveying units 3a, 3b, for the severing device 6 and the device 17, and for the pusher 11a. The overall weight and bulk of the apparatus are surprisingly small and this, too, is attributable to the absence of complex transmissions.

Still another important advantage of the improved apparatus is that the second conveyor 3 employs two disctete conveying units 3a, 3b which can be driven independently of each other. Thus, and as already mentioned above, it is possible to evacuate all of the blanks 1a before the apparatus is brought to a complete standstill because the operative connection 227 between the prime mover 127 and the conveying unit 3a can be interrupted at 327 while the conveying unit 3b continues to advance the blank or blanks 1a downwardly and out of the respective path. Moreover, the lower conveying unit 3b can be accelerated to such an extent that it can advance the trailing end of a blank 1a downwardly and beyond the path of the pusher 11a when one or more packets 7 are missing, i.e., when a blank would be likely to be engaged directly by the pusher 11a.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for draping packs of cigarettes or other smokers' products into light-transmitting deformable wrapping material, comprising a first conveyor having a plurality of open pockets and being movable along an endless first path to thereby move successive pockets to a predetermined position; a second conveyor having means for advancing a web of deformable light-transmitting wrapping material along a predetermined second path in front of the pocket occupying said predetermined position, said advancing means comprising a first endless conveying unit defining a first portion of said second path and a second endless conveying unit defining a second portion of said second path downstream of said first portion, said second conveyor further having discrete drive means for said conveying units; separate control means for the drive means for said second conveying unit; means for subdividing the leader of the web into a series of successive blanks in a portion of said second path which is disposed between said conveying units and is adjacent the pocket occupying said position, said first conveyor unit being arranged to advance blanks to said subdividing means and said drive means for said second unit comprising variable-speed drive and said separate control means including means for accelerating said second unit so as to advance blanks past and beyond said moving means in the absence of a pack between said moving means and the pocket occupying said predetermined position; a third conveyor having means for transporting successive packs of a series of packs in front of the blanks in said portion of said second path; and means for individually inserting packs into pockets occupying said position, including means for moving the packs against the blanks occupying said portion of said second path so that the blanks are draped around the packs entering the respective pockets.

2. The apparatus of claim 1, wherein said first conveyor includes a rotary turret which is indexible about a predetermined axis.

3. The apparatus of claim 1, further comprising a guide for packs which are being moved into the registering pockets.

4. The apparatus of claim 3, wherein said guide includes a mouthpiece which is disposed between said portion of said second path and the pocket occupying said position.

5. The apparatus of claim 1, further comprising a source of wrapping material, said second conveyor further having means for drawing the web from said source.

6. The apparatus of claim 1, further comprising a prime mover and means for transmitting motion from said prime mover to one of said drive means.

7. The apparatus of claim 6, wherein said one drive means drives said first conveying unit.

8. The apparatus of claim 7, further comprising means for disconnecting said one drive means from said prime mover.

9. The apparatus of claim 1, further comprising a source of wrapping material, said second conveyor further having means for drawing the web from said source and said drawing means being driven by the drive means for said first conveying unit and comprising a pair of rolls defining a nip for the web.

10. The apparatus of claim 1, wherein each of conveying units comprises one endless foraminous belt and means for establishing a pressure differential between opposite sides of said belts so as to pneumatically hold the web and the blanks in said second path.

11. The apparatus of claim 10, wherein each of said conveying units comprises a plurality of endless foraminous belt conveyors.

12. The apparatus of claim 1, further comprising means for making cuts in the blanks.

13. The apparatus of claim 10, further comprising common drive means for said severing means and for said means for making cuts.

14. The apparatus of claim 1, wherein said severing means comprises a rotary cross cutter at one side and a fixed counterknife at the other side of said second path.

15. The apparatus of claim 14, further comprising variable-speed drive means for said cross cutter.

16. The apparatus of claim 1, wherein said third conveyor comprises an endless conveyor arranged to advance packs along a third path, and means for transferring packs from said endless conveyor in front of said moving means.

17. The apparatus of claim 16, wherein said transferring means includes an elevator.

18. The apparatus of claim 1, wherein said moving means includes a driven pusher.

19. The apparatus of claim 1, further comprising means for monitoring said third conveyor for the absence of packs and for initiating acceleration of blanks by way of said control means in response to detected absence of packs on said third conveyor.

20. The apparatus of claim 19, wherein said monitoring means comprises a sensor arranged to generate signals in response to detected absence of packs on said third conveyor, said control means including means for applying to said drive means voltage signals in response to signals from said sensor.

21. The apparatus of claim 20, wherein said control means further comprises means for delaying said voltage signals so that the second conveying unit advances a blank beyond said moving means immediately before said moving means performs an idle stroke as a result of absence of a pack between said moving means and the pocket occupying said predetermined position.

22. The apparatus of claim 1, further comprising a guide for packs which are being moved into registering pockets; and means for synchronizing the operation of said severing and moving means so that the severing means separates a blank from the leader of the web when the blank which is about to be separated extends in part into said guide under the action of the pack which is being moved by said moving means.

23. The apparatus of claim 22, further comprising means for synchronizing the operation of said second conveyor and said moving means so that the speed of said second conveyor matches or closely approximates the speed of said moving means during separation of blanks from the leader of the web.

* * * * *